US006058743A

United States Patent [19]

Fujii et al.

[11] Patent Number: 6,058,743

[45] Date of Patent: May 9, 2000

[54] WASHING MACHINE

[75] Inventors: Hiroyuki Fujii, Hyogo-ken; Yuko Omura, Kyoto; Fumio Ota, Kawanishi, all of Japan

[73] Assignee: Matsushita Electric Industrial Co., Ltd., Osaka, Japan

[21] Appl. No.: 08/813,298

[22] Filed: Mar. 10, 1997

Related U.S. Application Data

[63] Continuation of application No. 08/447,774, May 23, 1995, abandoned.

[30] Foreign Application Priority Data

May 23, 1994 [JP] Japan ..... 6-108359

[51] Int. Cl.[7] ..... D06F 39/02; D06F 39/08

[52] U.S. Cl. ..... 68/12.18; 68/23.5; 68/207

[58] Field of Search ..... 68/23.5, 58, 148, 68/12.18, 17 R, 207

[56] References Cited

U.S. PATENT DOCUMENTS

| | | | |
|---|---|---|---|
| 3,066,521 | 12/1962 | Gillessen | 68/23.5 |
| 3,302,433 | 2/1967 | Nallinger | 68/23.5 X |
| 3,387,310 | 6/1968 | Marshall | 68/23.5 X |
| 3,388,410 | 6/1968 | Marshall | 68/23.5 X |
| 4,329,858 | 5/1982 | Okazaki | 68/23.5 X |
| 4,784,666 | 11/1988 | Brenner et al. | 68/23.5 X |
| 5,154,071 | 10/1992 | Singh et al. | 68/23.5 |
| 5,191,668 | 3/1993 | Euler et al. | 68/58 X |
| 5,345,637 | 9/1994 | Pastryk et al. | 68/23.5 X |

FOREIGN PATENT DOCUMENTS

| | | | |
|---|---|---|---|
| 33367 | 3/1977 | Japan | 68/58 |
| 288191 | 11/1988 | Japan | 68/148 |
| 2208080 | 2/1989 | United Kingdom | 68/23.5 |

*Primary Examiner*—Philip R. Coe
*Attorney, Agent, or Firm*—Louis Woo

[57] ABSTRACT

A washing machine includes a wash-and-dewatering sink 4, a motor 6 rotating the wash-and-dewatering sink 4, a detergent fluid supply device 12 supplying detergent fluid to clothes in the wash-and-dewatering sink 4, and control unit controlling both the motor 6 and the detergent fluid supply device 12 in such a manner, when the wash-and-dewatering sink 4 is rotated by the motor 6, detergent fluid is supplied to the clothes in the wash-and-dewatering sink 4 by the detergent fluid supply device 12.

4 Claims, 8 Drawing Sheets

WASHING MACHINE

This application is a continuation of U.S. patent application Ser. No. 08/447,774, filed May 23, 1995 now abandoned.

BACKGROUND OF THE INVENTION

1. Field of the Invention

This invention relates to a washing machine which sprinkles or showers detergent fluid on clothes while rotating a wash-and-dewatering sink.

2. Prior Art

Conventionally, many washing machines are of a stirrer or agitator type. Among them, representative is a pulsator type washing machine. According to this pulsator-type washing machine, clothes are put into a wash-and-dewatering sink, then a predetermined amount of water and detergent are added. Subsequently, the pulsator is rotated to mix up both the clothes and water. Stirring of clothes and water facilitates melting of detergent, making the detergent effectively act against stains or dirt of the clothes. Furthermore, stirring clothes and water increases frictions between adjacent clothes or between the clothes and an inside wall of wash-and-dewatering sink or the surface of the pulsator, thereby removing stains or dirt from the clothes.

According to such a conventional mix-up type washing machine, there are problems of damaging clothes by causing fluff, fray, or tangled extension. Reducing a mixing-up force will be one of ideas for reducing a frictional force acting on clothes, but will be encountered with another problem of lack of washing ability. Furthermore, in view of saving of resources such as water and detergent, the pulsator type washing machine consumes water of 40–60 liters and corresponding detergent for an ordinary washing. The water amount will rise up to 120 to 180 liters if the rinsing process is included, which is a significantly great amount.

SUMMARY OF THE INVENTION

Accordingly, in view of above-described problems encountered in the prior art, a principal object of the present invention is to provide a washing machine capable of removing stains or dirt from clothes by mixing up the clothes at a moderate mixing-up force not damaging clothes.

A second object of the present invention is to provide a washing machine capable of controlling the timing of supply of detergent to clothes so that the detergent effectively acts against the stains or dirt of the clothes, thereby saving water and detergent and removing stains or dirt without damaging clothes.

Furthermore, a third object of the present invention is to provide a washing machine capable of circulating detergent-containing washing water to repetitively supply it to clothes, thereby removing stains or dirt of clothes with the least water and detergent without damaging clothes.

Moreover, a fourth object of the present invention is to provide a washing machine capable of varying a washing water amount absorbed by clothes so that stains or dirt can be removed from the clothes in a relatively short time without damaging the clothes.

Yet further, a fifth object of the present invention is to provide a washing machine capable of operating a circulating means of washing water at optimum timings so that the detergent-containing washing water can effectively act against stains or dirt of the clothes, thereby saving energy and effectively removing stains or dirt without damaging the clothes.

Still further, a sixth object of the present invention is to provide a washing machine being free from unevenness of washing in the finished clothes.

In order to accomplish these and other related objects, a first aspect of the present invention provides a washing machine comprising: a wash-and-dewatering sink; actuating means for rotating the wash-and-dewatering sink; detergent fluid supply means for supplying detergent fluid to clothes in the wash-and-dewatering sink; and control means for controlling the actuating means and the detergent fluid supply means in such a manner, when the wash-and-dewatering sink is rotated by the actuating means, detergent fluid is supplied to the clothes in the wash-and-dewatering sink by the detergent fluid supply means.

With this arrangement, detergent fluid is supplied to the clothes which is subjected to the centrifugal force. Accordingly, both removing stains or dirt from the clothes into the detergent fluid and draining such detergent fluid can be simultaneously and continuously executed. Hence, removal of stains or dirt can be accomplished without causing friction between adjacent clothes.

A second aspect of the present invention provides a washing machine comprising: a wash-and-dewatering sink; actuating means for rotating the wash-and-dewatering sink at higher and lower rotational speeds; detergent fluid supply means for supplying detergent fluid to clothes in the wash-and-dewatering sink; and control means for controlling the actuating means and the detergent fluid supply means in such a manner, when the wash-and-dewatering sink is rotated at the lower rotational speed, detergent fluid is supplied to the clothes in the wash-and-dewatering sink by the detergent fluid supply means.

With this arrangement, detergent fluid is supplied to the clothes when the centrifugal force is small. Therefore, the supplied detergent fluid is so effectively absorbed in the clothes that stains or dirt can be sufficiently removed from or melted off the clothes. Thereafter, the rotational speed of the wash-and-dewatering sink is increased so as to enhance the centrifugal force. Thus, dirt-containing detergent fluid is effectively drained from the clothes.

Furthermore, a third aspect of the present invention provides a washing machine comprising: a water receiver sink accommodating a wash-and-dewatering sink disposed therein; actuating means for rotating the wash-and-dewatering sink at higher and lower rotational speeds; detergent fluid supply means for supplying detergent fluid into the wash-and-dewatering sink, the detergent fluid supply means including circulating means for circulating detergent fluid in the water receiver sink; and control means for controlling the actuating means and the detergent fluid supply means in such a manner, when the wash-and-dewatering sink is rotated by the actuating means, detergent fluid is supplied to clothes in the wash-and-dewatering sink by the detergent fluid supply means.

With this arrangement, detergent fluid is supplied to the clothes which is subjected to the centrifugal force. Accordingly, both removing stains or dirt from the clothes into the detergent fluid and draining such detergent fluid can be simultaneously executed. Furthermore, the detergent fluid is continuously and repetitively supplied to the clothes by the circulating means. Hence, removal of stains or dirt can be accomplished by a quite small amount of detergent fluid without causing friction between adjacent clothes.

Moreover, a fourth aspect of the present invention provides a washing machine comprising: a water receiver sink accommodating a wash-and-dewatering sink disposed therein; actuating means for rotating the wash-and-dewatering sink at higher and lower rotational speeds; detergent fluid supply means for supplying detergent fluid into the wash-and-dewatering sink, the detergent fluid supply means including circulating means for circulating detergent fluid in the water receiver sink; and control means for controlling the actuating means and the detergent fluid supply means in such a manner, when the wash-and-dewatering sink is rotated by the actuating means, detergent fluid is supplied to clothes in the wash-and-dewatering sink by the detergent fluid supply means.

With this arrangement, detergent fluid is supplied to the clothes when the centrifugal force is small. Therefore, the supplied detergent fluid is so effectively absorbed in the clothes that stains or dirt can be sufficiently removed from or melted off the clothes. Thereafter, the rotational speed of the wash-and-dewatering sink is increased so as to enhance the centrifugal force. Thus, dirt-containing detergent fluid is effectively drained from the clothes. By repeating these operations, stains or dirt can be smoothly removed within a short time without causing friction between clothes.

Still further, a fifth aspect of the present invention provides a washing machine comprising: a water receiver sink accommodating a wash-and-dewatering sink disposed therein; actuating means for rotating the wash-and-dewatering sink at higher and lower rotational speeds; detergent fluid supply means for supplying detergent fluid into the wash-and-dewatering sink, the detergent fluid supply means including circulating means for circulating detergent fluid in the water receiver sink; and control means for executing first and second processes, wherein detergent fluid is supplied to clothes in the wash-and-dewatering sink by the detergent fluid supply means when the wash-and-dewatering sink is rotated at the lower rotational speed in the first process, while detergent fluid is not supplied to the clothes in the wash-and-dewatering sink when the wash-and-dewatering sink is rotated at the higher rotational speed in the second process.

In this washing machine, it is preferable that the first and second processes are successively and cyclically executed.

With this arrangement, detergent fluid is supplied to the clothes when the centrifugal force is small. Therefore, the supplied detergent fluid is so effectively absorbed in the clothes that stains or dirt can be sufficiently removed from or melted off the clothes. Thereafter, the supply of detergent fluid is stopped and the rotational speed of the sink is increased so as to enhance the centrifugal force. Thus, dirt-containing detergent fluid is effectively drained from the clothes. In this manner, a washing operation is separated into two process, one process removing stains or dirt from the clothes into the detergent fluid and the other process draining such dirt-containing detergent fluid. Furthermore, the circulating means is operated effectively in the first process. Thus, removal of stains and dirt can be accomplished with a least energy consumption.

Yet further, a sixth aspect of the present invention provides a washing machine comprising: a water receiver sink accommodating a wash-and-dewatering sink disposed therein; actuating means for rotating the wash-and-dewatering sink; detergent fluid supply means for supplying detergent fluid into the wash-and-dewatering sink; and control means for controlling the actuating means and the detergent fluid supply means in such a manner, when the wash-and-dewatering sink is rotated by the actuating means, detergent fluid is supplied to clothes in the wash-and-dewatering sink by the detergent fluid supply means, wherein the detergent fluid supply means varies a direction of detergent fluid injected into the wash-and-dewatering sink.

With this arrangement, detergent fluid is accurately and uniformly supplied to the clothes even if the clothes are shifted in the up-and-down direction due to variation of centrifugal force, thereby eliminating unevenness of washing in the finished clothes.

Moreover, a seventh aspect of the present invention provides a washing machine comprising: a wash-and-dewatering sink; actuating means for rotating the wash-and-dewatering sink in a predetermined range between higher and lower rotational speeds; detergent fluid supply means for supplying detergent fluid to clothes in the wash-and-dewatering sink; and control means for controlling the actuating means and the detergent fluid supply means in such a manner, when the wash-and-dewatering sink is decelerated from the higher rotational speed to the lower rotational speed, detergent fluid is supplied to the clothes in the wash-and-dewatering sink by the detergent fluid supply means.

In this washing machine, it is preferable that the control means controls the actuating means and the detergent fluid supply means in such a manner, when the wash-and-dewatering sink is accelerated from the lower rotational speed to the higher rotational speed, detergent fluid is supplied to the clothes in the wash-and-dewatering sink by the detergent fluid supply means.

With this arrangement, detergent fluid is supplied to the clothes when the centrifugal force is small. Therefore, the supplied detergent fluid is so effectively absorbed in the clothes that stains or dirt can be sufficiently removed from or melted off the clothes. Thus, removal of stains and dirt can be accomplished with the least energy consumption.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
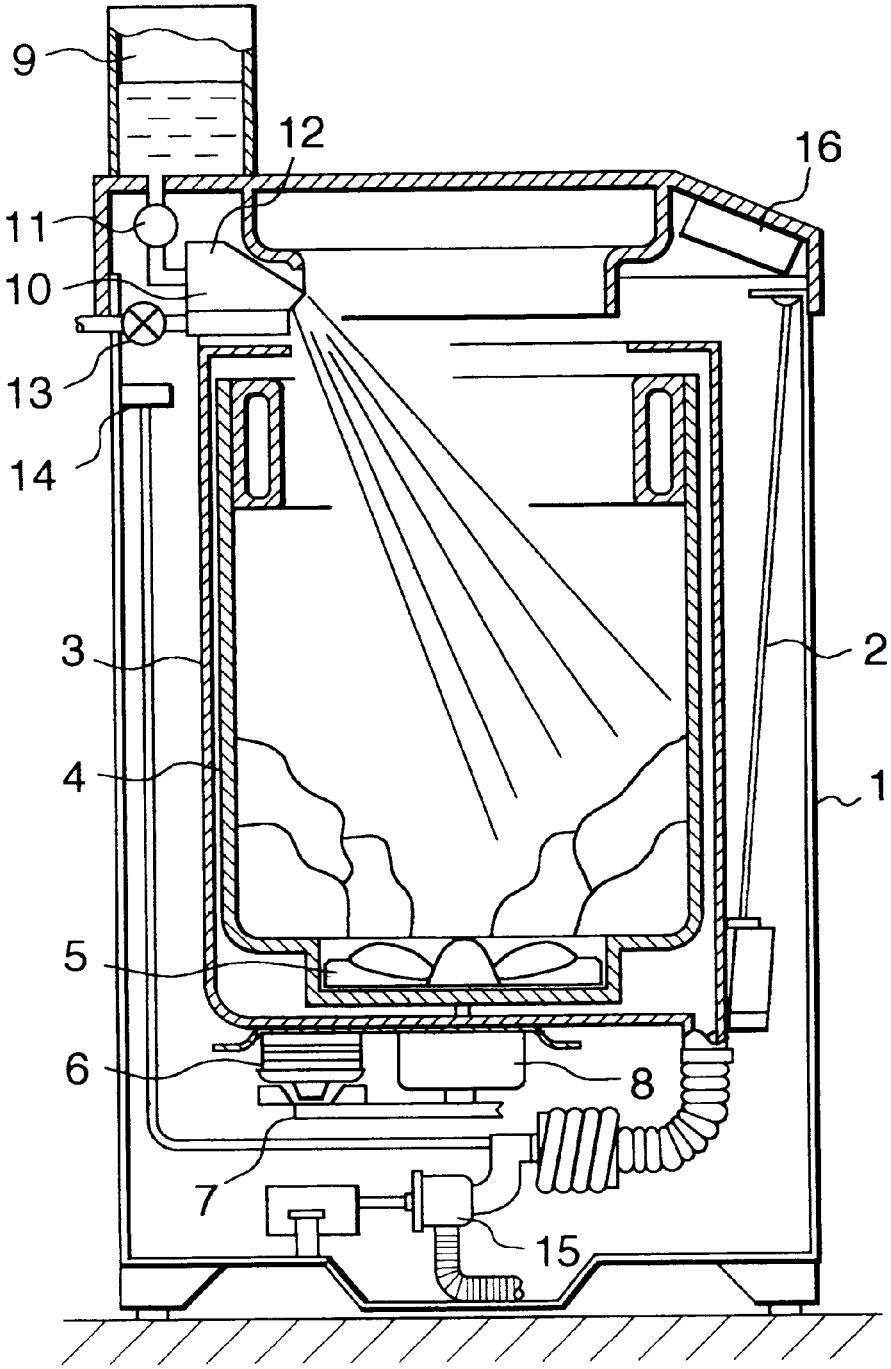
FIG. 1 is a cross-sectional view schematically showing a washing machine in accordance with a first embodiment of the present invention.

Preferred embodiments of the present invention will be explained in greater detail hereinafter, with reference to the accompanying drawings. Identical parts are denoted by identical reference numeral throughout views.

As shown in FIG. 1, a washing machine comprises a casing 1 which supports a water receiver sink 3 via four hanging bars 2. A wash-and-dewatering sink (hereinafter referred to a washing sink) 4 is disposed rotatably in the water receiver sink 3. A stirring wing 5 is rotatably disposed on the bottom of the washing sink 4. A motor (i.e. an actuating means) 6 drives the stirring wing 5 and the washing sink 4 through a speed-reduction mechanism 8. A detergent fluid tank 9 is provided at an upper part of the washing machine casing 1. The detergent fluid tank 9 is communicated with a sprinkle nozzle 10 via a valve 11. The sprinkle nozzle 10 sprinkles detergent fluid, supplied from the detergent fluid tank 9, into the washing sink 4. The detergent fluid tank 9, the sprinkle nozzle 10 and the valve 11 cooperatively constitute a detergent fluid supply means 12. A water supply means 13 supplies clean water into the washing sink 4. A water level sensor 14 detects a water level in the water receiver sink 3. A drain means 15 drains the washing water from the water receiver sink 3. A control unit 16 is provided on the upper surface of the washing machine casing 1.

Figure 2:
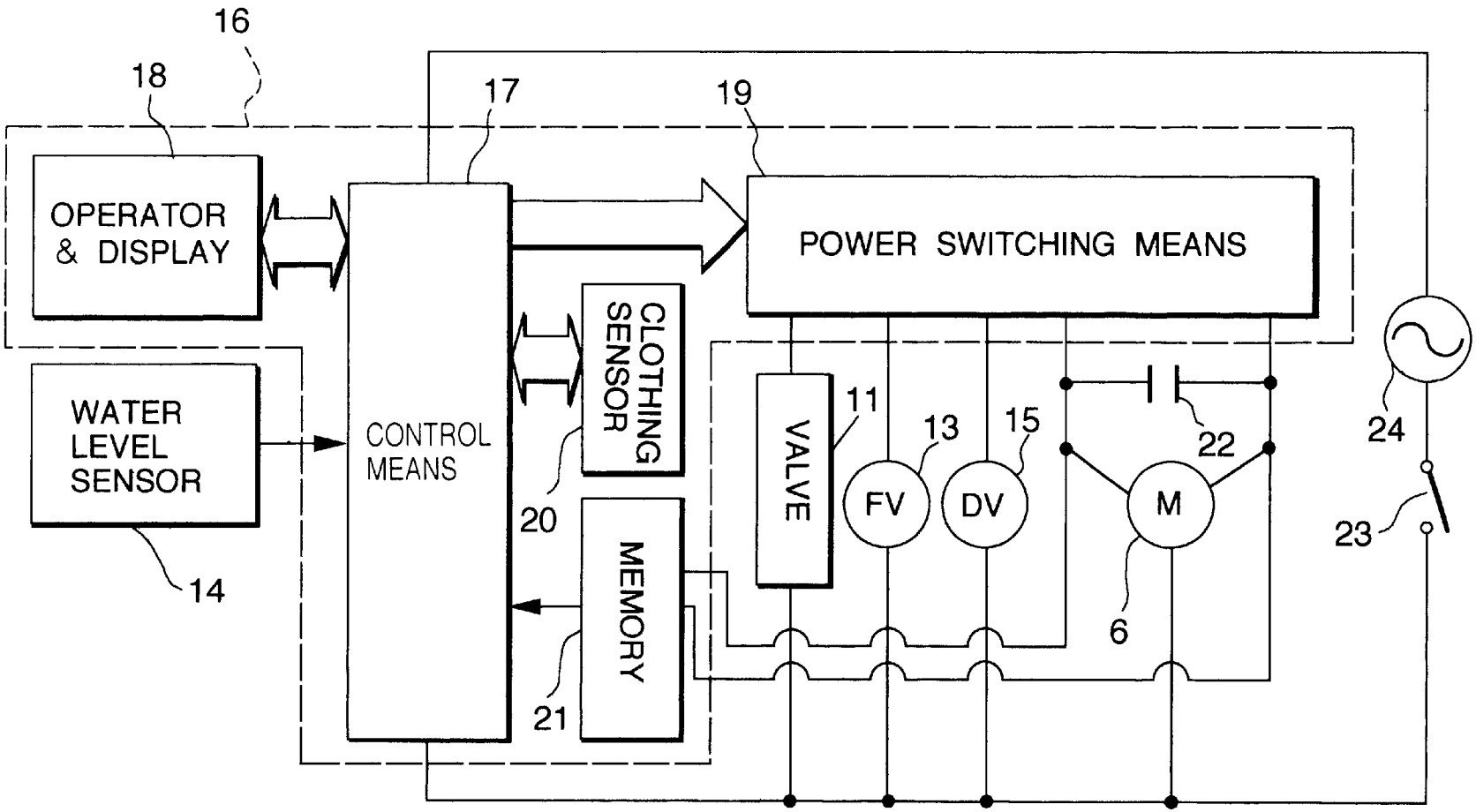
FIG. 2 is a block diagram showing the washing machine in accordance with the first embodiment of the present invention.

The control unit 16 has an arrangement shown in FIG. 2. A control means 17 receives various setting data entered from an operation & display means 18 and controls each of sequentially executed washing, rinsing and dewatering processes of the washing machine operation based on the setting data thus entered. The control means 17 further controls the motor 6, the valve 11, the water supply means 13 and the drain means 15 via a power switching means 19. A memory means 20 memorizes numerous data required for various controls executed by the control means 17. A clothing sensor 21 detects an amount of clothes in the washing sink 4, an output of which is entered into the control means 17. A reference numeral 22 represents a phase-advancing capacitor, a reference numeral 23 represents a power unit switch, and a reference numeral 24 represents a commercially available power unit. The control means 17 controls the motor 6 to rotate the washing sink 4, while causing the detergent fluid supply means 12 to supply detergent fluid to the clothes in the washing sink 4.

Operation of the above-described first embodiment washing machine will be described below. After clothes are put into the washing sink 4, operation of the washing machine is started. More specifically, the drain means 15 starts its operation and the motor 6 is driven to rotate the washing sink 4. With this rotation, the clothes in the washing sink 4 are subjected to a significant amount of centrifugal force and moved toward the inner side wall of the bottom part of the washing sink 4. At the moment that the rotational speed of the washing sink 4 just reaches a predetermined value (e.g. 150–250 rpm), the valve 11 is opened to supply detergent fluid from the detergent fluid tank 9 to the sprinkle nozzle 10, thereby sprinkling the detergent fluid onto the clothes staying on the inner side wall of the bottom part of the washing sink 4.

The detergent fluid, having reached the clothes, acts against stains or dirt of the clothes, thereby melting the stains or dirt into the detergent fluid. And then, the detergent fluid containing the melted stains or dirt passes through and is removed from the clothes due to the centrifugal force. In other words, supply of clean detergent fluid and drain of dirty detergent fluid are simultaneously executed. Continuation of this process for a predetermined time assures effective removal of stains or dirt from the clothes into the detergent fluid, thereby promoting the removal operation of stains or dirt.

Subsequently, after the washing process is finished, a dewatering process is started to remove or drain the dirty detergent fluid. In this dewatering process, the detergent fluid supply means 12 is deactivated and the washing sink 4 is continuously rotated at higher rotational speed (for example, 900–1000 rpm) for a predetermined time. Then, after finishing the dewatering process, the drain means 15 is deactivated and the water supply means 13 is operated to feed clean water into the washing sink 4 for rinsing the clothes. Thereafter, several rinsing processes and a final dewatering process are successively executed, thus completing all the processes of the washing machine operation.

Figure 3:
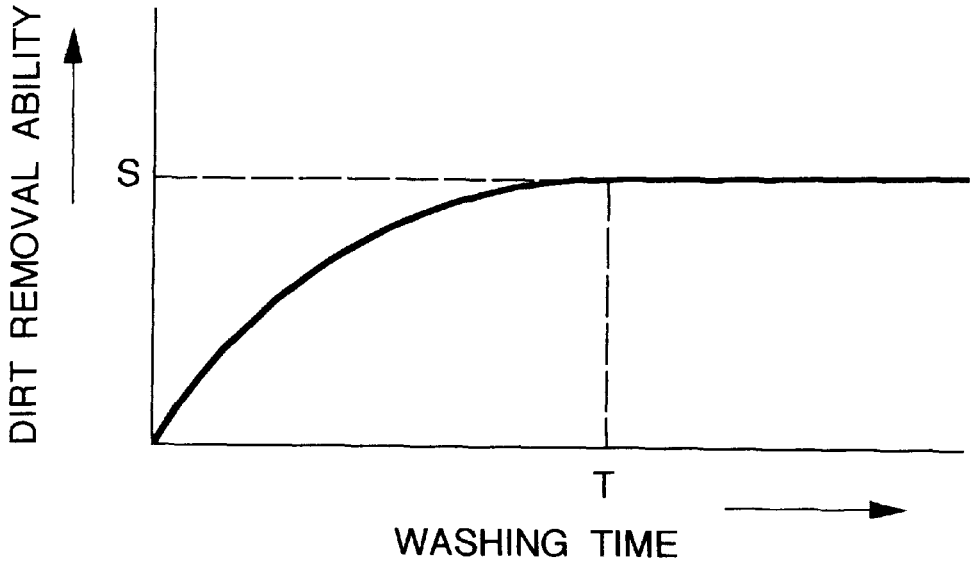
FIG. 3 is a graph showing the washing performance of the washing machine in accordance with the first embodiment of the present invention.

FIG. 3 is a graph showing a relationship between the washing time and the dirt removal ability (i.e. washing ability or detergency) in accordance with the present embodiment. As shown in FIG. 3, the inventors of the present invention confirmed based on experiments that removal of stains or dirt progresses or advances as the washing time increases. Furthermore, it is confirmed that the increase of dirt removal ability is ceased or saturated at a specific washing time T as shown in FIG. 3.

Next, a second embodiment of the present invention will be explained. Under the control of control means 17 of FIG. 2, the washing sink 4 is driven in a predetermined range between two rotational speeds, a higher rotational speed R1 (for example, 150–300 rpm) and a lower rotational speed R2 (for example, 50–100 rpm). When the washing sink 4 is rotated at the lower speed R2, the control means 17 controls the detergent fluid supply means 12 to sprinkle detergent fluid on the clothes in the washing sink 4. Other structural or systematical features of the second embodiment are the same as those of the first embodiment.

Figure 4:
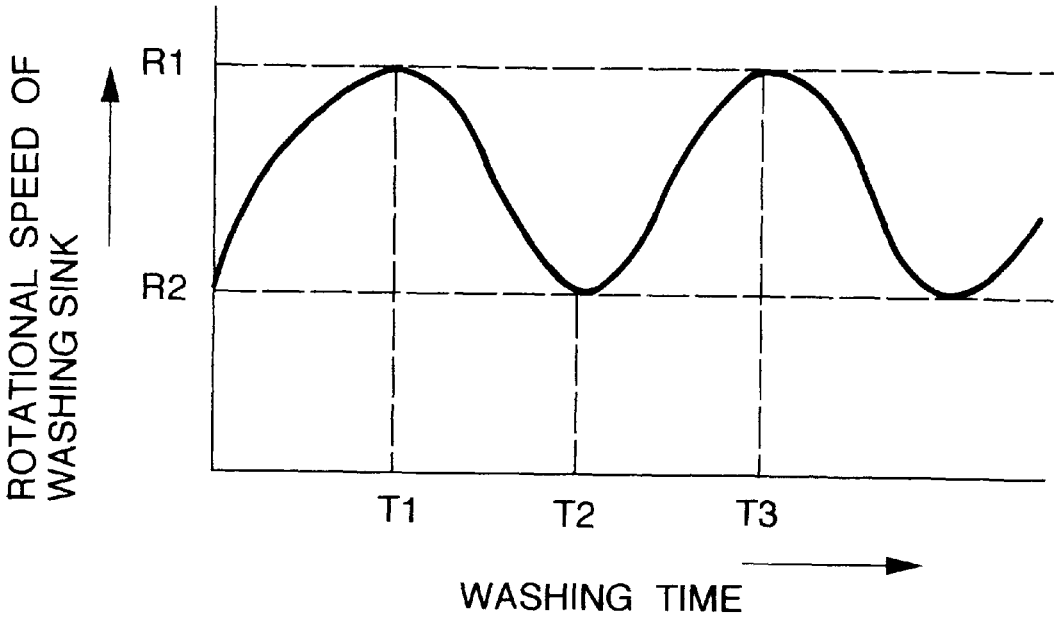
FIG. 4 is a time chart illustrating the rotational speed control of the washing machine in accordance with a second embodiment of the present invention.

With reference to the graph of FIG. 4, operation of the above-described second embodiment washing machine will be explained. FIG. 4 is a graph showing a relationship between the washing time and the rotational speed of the washing sink 4. As shown in FIG. 4, the rotational speed of the washing sink 4 varies cyclically in the range from R2 to R1 under the control of the control means 17. The detergent fluid supply means 12 is activated during a period from T1 to T2 where the rotational speed of the washing sink 4 is reduced from the higher rotational speed R1 to the lower rotational speed R2.

In this case, the centrifugal force acting on the clothes is gradually weakened with reducing rotational speed of the washing sink 4. Thus, the ability of draining detergent fluid is lowered; namely, the amount of detergent fluid absorbed in the clothes is increased. In other words, the clothes are soaked in the detergent fluid for a while. For this reason, the total amount of detergent fluid acting against stains or dirt of the clothes can be increased. And, the action time of detergent fluid to the stains or dirt will be desirably extended.

In turn, the rotational speed of the washing sink 4 is increased from the lower rotational speed R2 to the higher rotational speed R1 during a period from T2 to T3. In this period, the detergent fluid supply means 12 is deactivated. Namely, no detergent fluid is supplied to the clothes during such an acceleration period. Since the centrifugal force acting on the clothes is enhanced, detergent fluid containing stains or dirt is drained. In this manner, the rotational speed of the washing sink 4 is varied cyclically between the predetermined upper and lower rotational speeds, so as to change the centrifugal force acting on the clothes. The detergent fluid is supplied to the clothes at optimum timings so that the detergent effectively acts against stains or dirt. As a result, a washing operation is accomplished with a least amount of detergent fluid.

Figure 5:
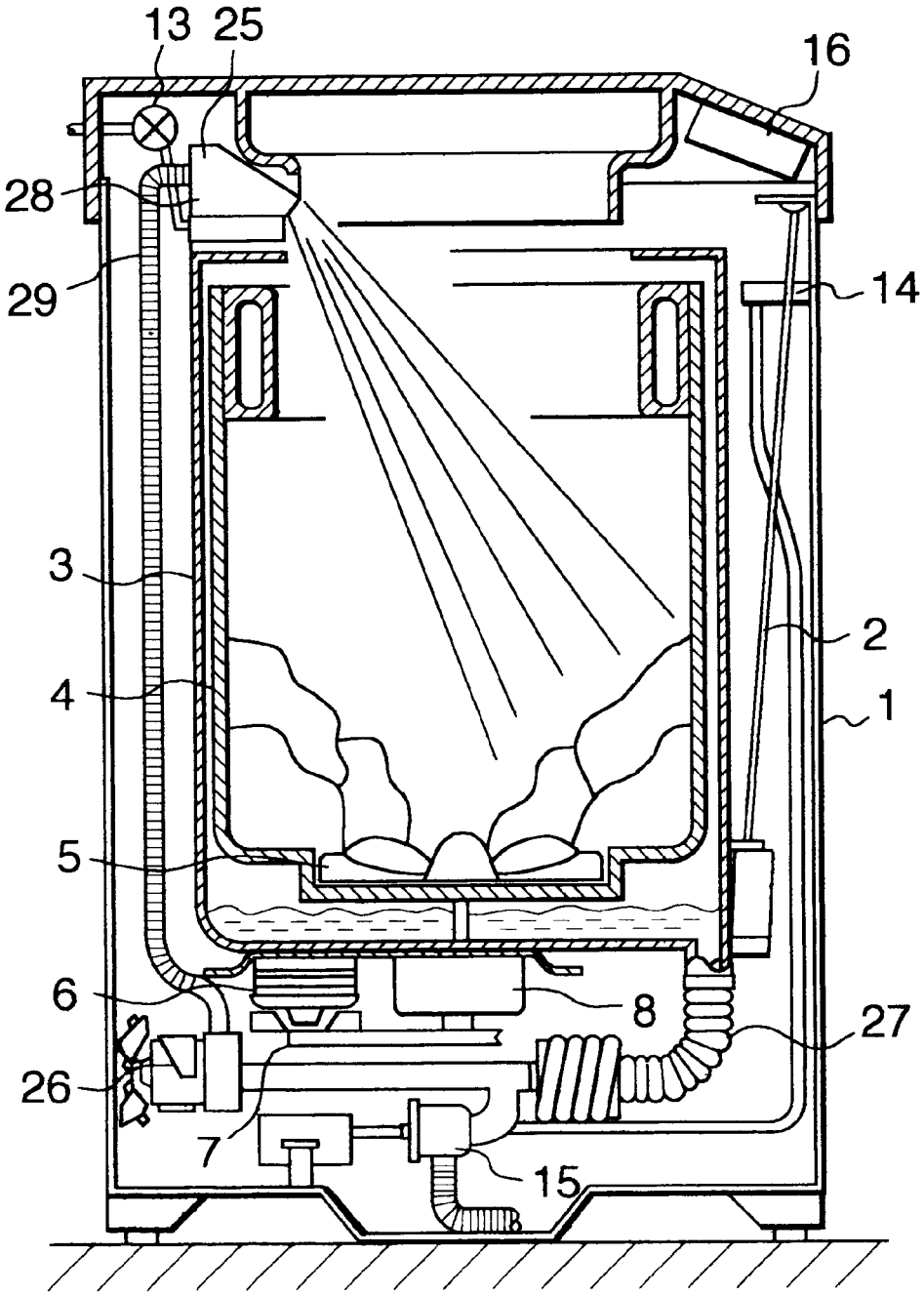
FIG. 5 is a cross-sectional view schematically showing a washing machine in accordance with a third embodiment of the present invention.

Next, a third embodiment of the present invention will be explained with reference to FIGS. 5 and 6. As shown in the drawing, a circulating means 25, circulating detergent-containing washing water in the water receiver sink 3, comprises a circulating pump 26, a first circulating passage 27 connecting the circulating pump 26 and the bottom of the water receiver sink 3, and a second circulating passage connecting the circulating pump 26 and the sprinkle nozzle 28 provided at the upper part of the washing sink 4.

A control means 30 causes the motor 6 to rotate the washing sink 4, while actuating the circular pump 26. Washing water in the water receiver sink 3 is circulated from the bottom of the washing sink 4 to the sprinkle nozzle 28, so that the used detergent fluid is repetitively sprayed on the clothes.

Operation of the above-described third embodiment washing machine will be explained. After clothes are put and detergent is added into the washing sink 4, operation of the washing machine is started. In response to this starting operation, the water supply means 13 is activated to supply a required amount of clean water into the water receiver sink 3. When the water level sensor 14 detects the supplied amount of water reaching a predetermined level, the water supply means 13 is deactivated. Subsequently, the washing sink 4 starts rotating in response to activation of the motor 6. Rotation of the washing sink 4 causes a centrifugal force acting on each cloth, the magnitude of which is sufficiently large to forcibly move the clothes toward the outer peripheral end of the washing sink.

At the moment that the rotational speed of the washing sink 4 just reaches a predetermined value (e.g. 150–250 rpm), the circulating pump 26 starts its operation. Activation of the circulating pump 26 allows the detergent-containing washing fluid in the bottom of the water receiver sink 3 to enter the circulating pump 26 via the first circulating passage 27. The circulating pump 26 functions to pump up the detergent-containing washing fluid to the sprinkle nozzle 28 via the second circulating passage 29. Then, the detergent-containing washing fluid is sprinkled through the sprinkle nozzle 28 onto the clothes staying on the inner side wall of the bottom part of the washing sink 4.

The detergent fluid, having reached the clothes, acts against stains or dirt of the clothes, thereby melting the stains or dirt into the detergent fluid. And then, the detergent fluid containing the melted stains or dirt passes through and is removed from the clothes due to the centrifugal force. In other words, supply of clean detergent fluid and drain of dirty detergent fluid are simultaneously executed. Meanwhile, the detergent fluid removed off the clothes due to the centrifugal force is sucked by the circulating means 25 and sprinkled from the top of the washing sink 4. Accordingly, the detergent-containing washing fluid is repetitively used for removing stains or dirt from the clothes.

Repeating such a series of processes of supplying detergent fluid to clothes, melting stains or dirt into the detergent fluid, removing detergent fluid from the clothes, and circulating the used detergent fluid by the circulating means 25 will assure effective removal of stains or dirt from the clothes into the detergent fluid, thereby promoting the removal operation of stains or dirt.

Figure 7:
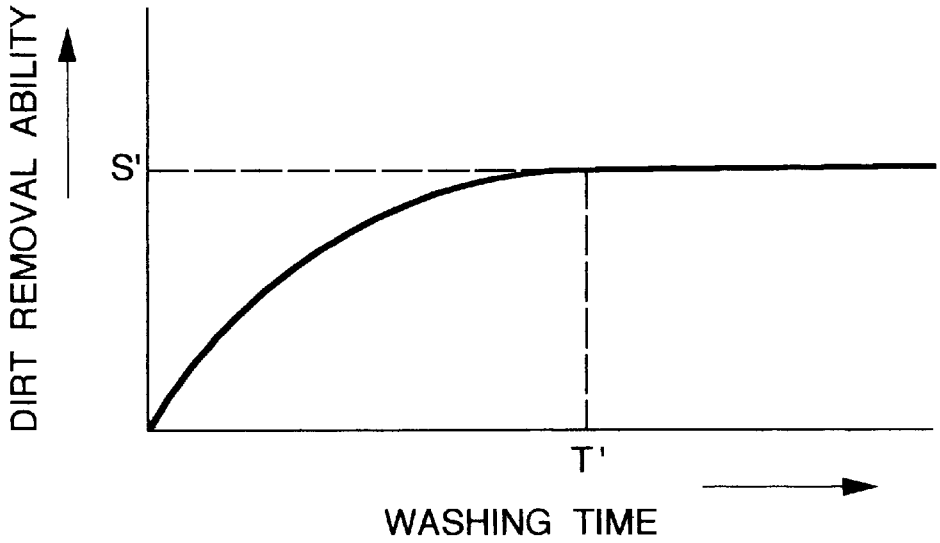
FIG. 7 is a graph showing the washing performance of the washing machine in accordance with the third embodiment of the present invention.

Subsequently, after the washing process is finished, a dewatering process is started to remove or drain the dirty detergent fluid. In this dewatering process, the circulating means 25 is deactivated and the drain means 15 starts an operation of draining the dirty detergent-containing washing fluid from the water receiver sink 3. In this case, the washing sink 4 is continuously rotated at higher rotational speed (for example, 900–1000 rpm) to execute a dewatering process at a time, thereby shortening the total time of all the washing processes. Then, after finishing the dewatering process, the drain means 15 is deactivated and the water supply means 13 is operated to feed a predetermined amount of clean water into the washing sink 4 for rinsing the clothes. Thereafter, several rinsing processes and a final dewatering process are successively executed, thus completing all the processes of the washing machine operation. FIG. 7 is a graph showing a relationship between the washing time and the dirt removal ability in accordance with the third embodiment. As shown in FIG. 7, the inventors of the present invention confirmed, based on experiments, that removal of stains or dirt progresses or advances as the washing time increases. Furthermore, it is confirmed that the increase of dirt removal ability is substantially ceased or saturated at a specific washing time T' as shown in FIG. 7. Hence, the time T' can be designated as an end of the washing process.

Next, a fourth embodiment of the present invention will be explained.

Figure 6:
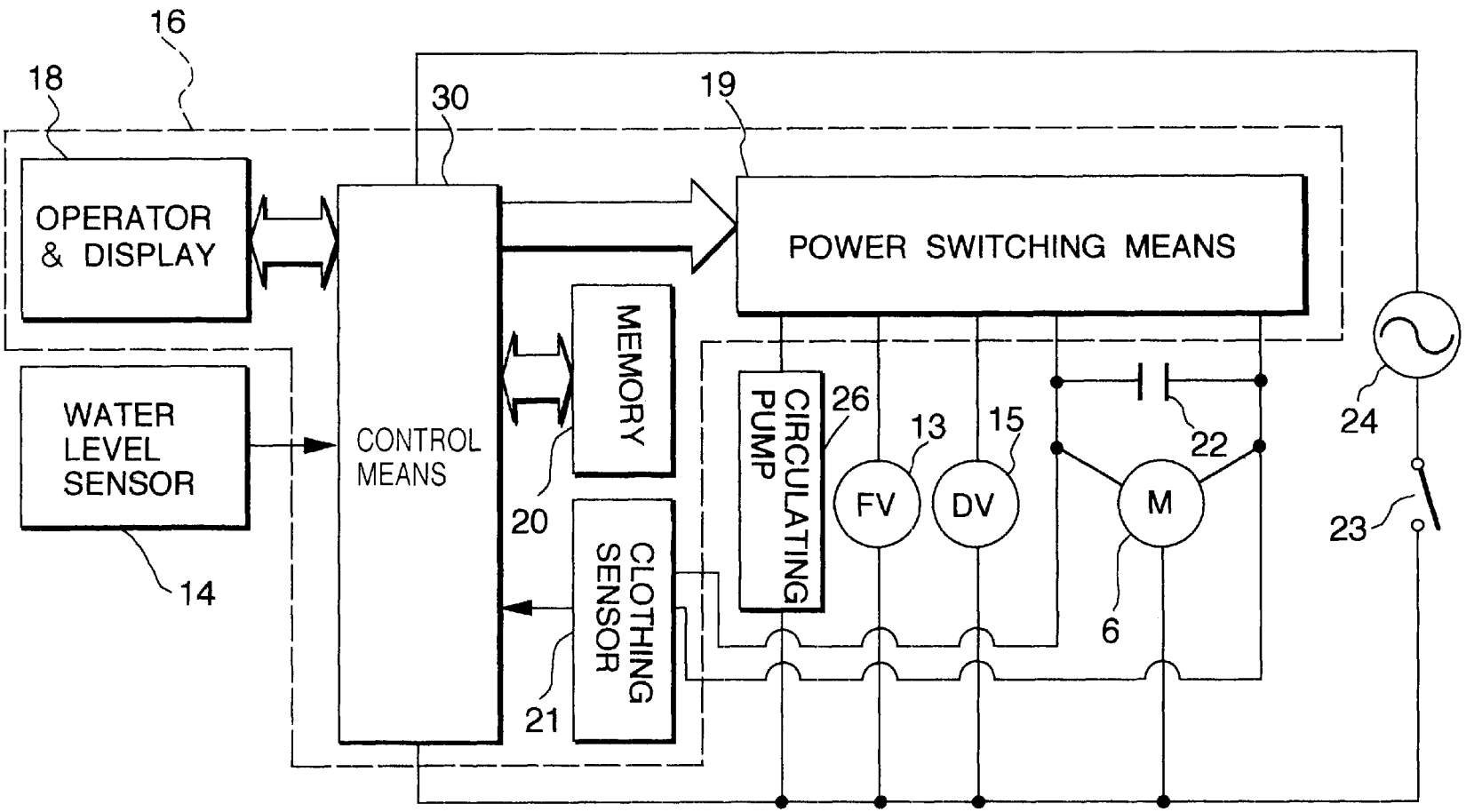
FIG. 6 is a block diagram showing the washing machine in accordance with the third embodiment of the present invention.

According to the fourth embodiment of the present invention, the control means 30 of FIG. 6 causes the motor 6 to rotate the washing sink 4 while controlling the circulating means 25 to supply detergent fluid to the clothes in the washing sink 4. The washing sink 4 is driven at different two speeds; more specifically, the rotational speed of the washing sink 4 is varied in a predetermined range between a higher rotational speed R1' (e.g. 150–300 rpm) and a lower rotational speed R2' (e.g. 50–100 rpm). Other features of the fourth embodiment are the same as those of the third embodiment.

Figure 8:
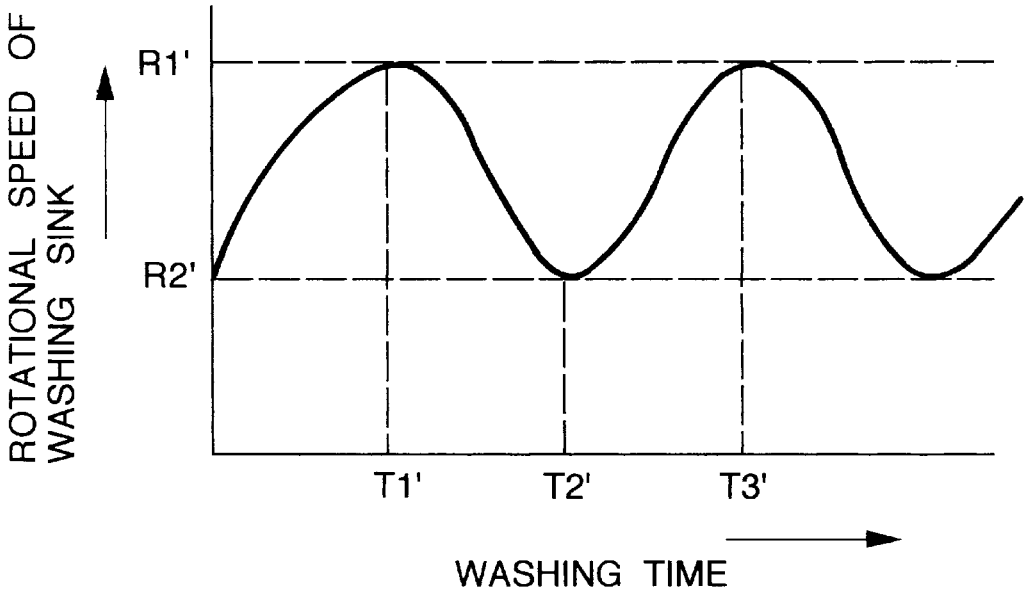
FIG. 8 is a time chart illustrating the rotational speed control of the washing machine in accordance with a fourth embodiment of the present invention.

With reference to the graph of FIG. 8, operation of the above-described fourth embodiment washing machine will be explained. FIG. 8 is a graph showing a relationship between the washing time and the rotational speed of the washing sink 4. As shown in FIG. 8, the rotational speed of the washing sink 4 varies cyclically in the range from R2' to R1' under the control of the control means 30. The circulating means 25 is activated during a period from T1' to T2' where the rotational speed of the washing sink 4 is reduced from the higher rotational speed R1' to the lower rotational speed R2'.

In this case, the centrifugal force acting on the clothes is gradually weakened with reducing rotational speed of the washing sink 4. Thus, the ability of draining detergent fluid is lowered; namely, the amount of detergent fluid absorbed in the clothes is increased. In other words, the clothes are soaked in the detergent fluid for a while. For this reason, the total amount of detergent fluid acting against stains or dirt of clothes can be increased. And, the action time of detergent fluid to the stains or dirt will be extended.

In turn, the rotational speed of the washing sink 4 is increased from the lower rotational speed R2' to the higher rotational speed R1' during a period from T2' to T3'. In this period, the centrifugal force acting on the clothes is increased. That is, the total amount of detergent fluid contained in the clothes is reduced.

Figure 9:
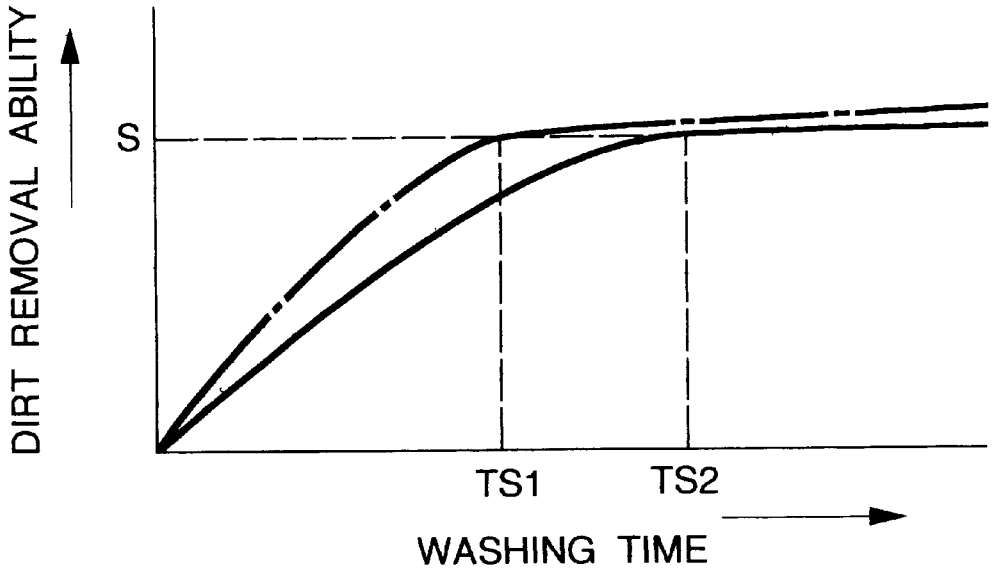
FIG. 9 is a graph showing the washing performance of the washing machine in accordance with the fourth embodiment of the present invention.

FIG. 9 is a graph showing a relationship between the washing time and the dirt removal ability in accordance with the fourth embodiment, wherein an alternate long and short dash line represents data obtained in the experiment wherein the rotational speed of the washing sink 4 is varied in the range between R1' and R2' while a solid line represents data obtained in the experiment wherein the rotational speed of the washing sink 4 is not varied. In both cases, the dirt removal ability is increased up to a predetermined value S, although the washing time required to reach that value S is different. As clearly understood from FIG. 9, the washing time $T_s$1 is fairly smaller than the washing time $T_s$2. Thus, it is confirmed that the washing operation is completed in a short time by varying the rotational speed of the washing sink 4 cyclically between the higher and lower rotational speeds with supply of detergent fluid by the circulating means 25.

A fifth embodiment of the present invention will be explained.

According to the fifth embodiment washing machine, the control means 30 of FIG. 6 cyclically repeats a first process and a second process. In the first process, the washing sink 4 is rotated at a lower rotational speed (e.g. 50–100 rpm) while the circulating means 25 supplies detergent fluid to the clothes. The second process follows the first process. In this second process, the supply of detergent fluid is stopped and the washing sink 4 is rotated at a higher speed (e.g. 150–300 rpm). Other features are the same as those of the above-described third embodiment.

Figure 10:
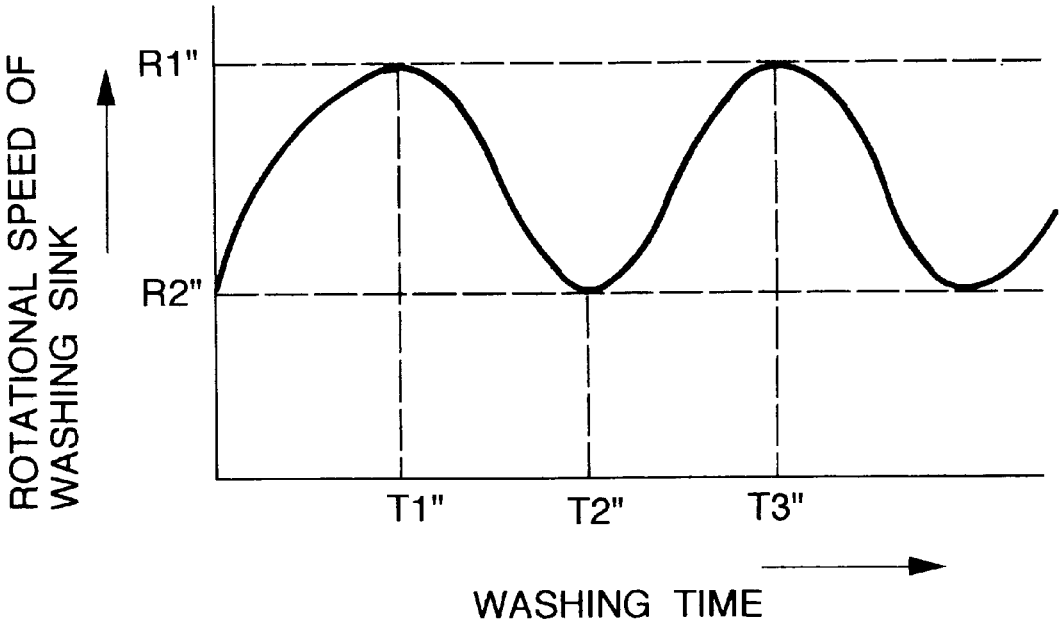
FIG. 10 is a time chart illustrating the rotational speed control of the washing machine in accordance with a fifth embodiment of the present invention.

With reference to the graph of FIG. 10, operation of the above-described fifth embodiment washing machine will be explained. FIG. 10 is a graph showing a relationship between the washing time and the rotational speed of the washing sink 4. As shown in FIG. 10, the rotational speed of the washing sink 4 varies cyclically in the range between the higher rotational speed R1" and the lower rotational speed R2" under the control of the control means 30. The circulating means 25 is activated during a period from T1" to T2" where the rotational speed of the washing sink 4 is reduced from the higher rotational speed R1" to the lower rotational speed R2".

In this case, the centrifugal force acting on the clothes is gradually weakened with reducing rotational speed of the washing sink 4. Thus, the ability of draining detergent fluid is lowered; namely, the amount of detergent fluid contained in the clothes is increased. In other words, the clothes are soaked in the detergent fluid for a while. For this reason, the total amount of detergent fluid acting against stains or dirt of clothes can be increased. And, the action time of detergent fluid to the stains or dirt will be desirably extended.

In turn, the rotational speed of the washing sink 4 is increased from the lower rotational speed R2" to the higher rotational speed R1" during a period from T2" to T3". In this accelerating period, the centrifugal force acting on the clothes is increased and the total amount of detergent fluid absorbed in the clothes is reduced. And, the circulating means 25 is stopped. That is, the detergent fluid containing molten stains or dirt is chiefly drained in this acceleration period.

In this manner, the fifth embodiment not only varies the rotational speed of the washing sink 4 for changing the magnitude of the centrifugal force acting on the clothes but supplies detergent fluid at optimum timings. Thus, the circulating means 25 is effectively operated with a significant amount of saved energy.

Figure 11:
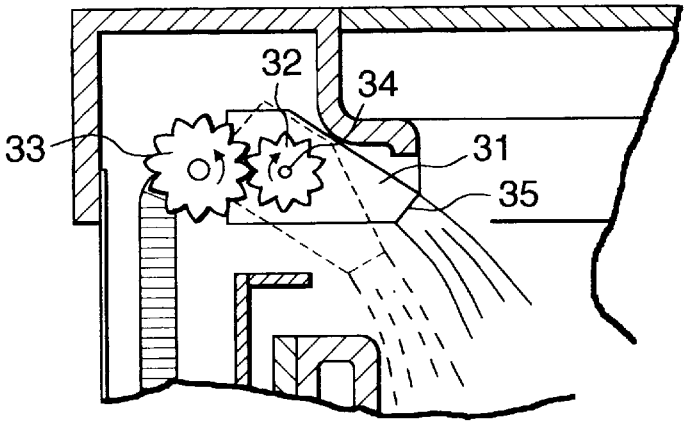
FIG. 11 is an enlarged cross-sectional view showing an essential part of a washing machine in accordance with a sixth embodiment of the present invention.

Next, a sixth embodiment of the present invention will be explained with reference to FIGS. 11 and 12.

As shown in the drawing, a sprinkle nozzle 31 is swingable about its supporting axis 34. More specifically, a first gear 32 is integrally fixed on the sprinkle nozzle 31. The first gear 32 is meshed with a second gear 33 which is driven by an appropriate actuating means (not shown). With this arrangement, the sprinkle nozzle 31 causes a swing motion in a predetermined angle in response to forward and reverse rotations of the first and second gears 32 and 33.

Operation of the above-described sixth embodiment will be explained. Under the condition where the detergent fluid is sprinkled by the sprinkle nozzle 31, the second gear 33 is driven. The first gear 32 meshing with the second gear 33 is rotated in response to the rotation of the second gear 33. Thus, the sprinkle nozzle 31 integral with the first gear 32 is swung. That is, the position and angle of the sprinkle port 35 of the sprinkle nozzle 31 can be changed in an up-and-down direction, by rotating gears 32 and 33 of the gear mechanism.

Figure 12:
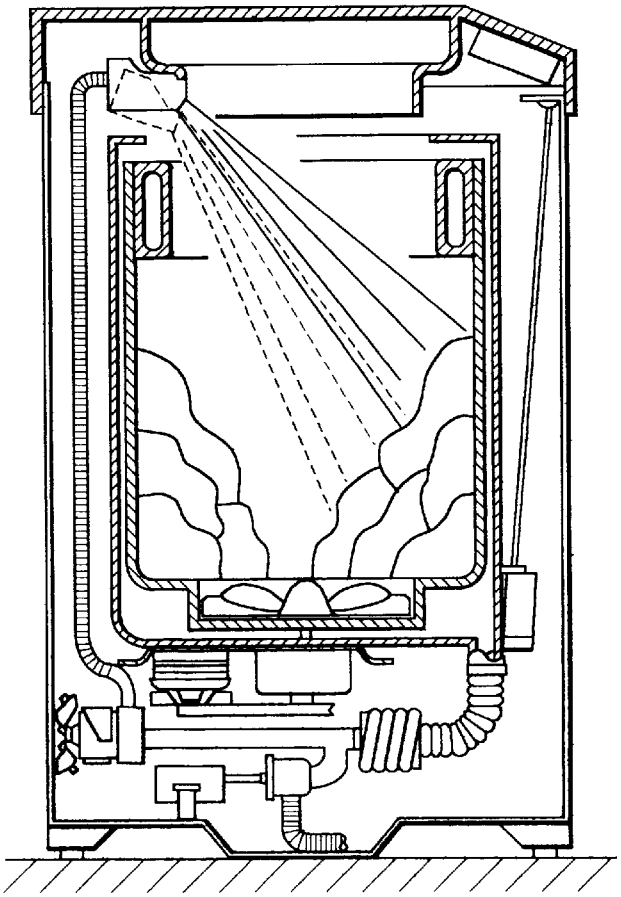
FIG. 12 is a cross-sectional view schematically showing a washing machine in accordance with the sixth embodiment of the present invention.

Accordingly, when detergent fluid is directly injected toward the inside wall of the washing sink 4, the direction of injected detergent fluid can be arbitrarily changed as shown in FIG. 12. Hence, even if clothes are shifted upward along the inside wall of the washing sink 4 during the dewatering operation, the detergent fluid can be uniformly supplied to whole part of the clothes. Thus, unevenness in supplying detergent fluid to the clothes can be eliminated.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A washing machine comprising:

a water receiver sink for accommodating therewithin a wash-and-dewatering sink;

actuating means for rotating said wash-and-dewatering sink;

detergent fluid supply means for supplying detergent fluid to clothes in said wash-and-dewatering sink, said detergent fluid containing detergent component chemically acting against stains or dirt of the clothes; and control means for cooperatively controlling said actuating means and said detergent fluid supply means in such a manner that said detergent fluid is supplied to the clothes in said wash-and-dewatering sink from said detergent fluid supply means only when the rotational speed or acceleration of said wash-and-dewatering sink effected by said actuating means is being reduced so that a decreasingly smaller centrifugal force acts on said clothes.

2. The washing machine in accordance with claim 1, wherein said control means effects said detergent fluid supply means to supply said detergent fluid to the clothes only when the rotational speed of said wash-and-dewatering sink is being reduced from a predetermined speed to a predetermined lower speed.

3. The washing machine in accordance with claim 1, wherein said control means effects said detergent fluid supply means to supply said detergent fluid to the clothes only when the rotational speed or acceleration of said wash-and-dewatering sink is continuously being reduced.

4. The washing machine in accordance with claim 1, wherein said control means effects said actuating means to vary the rotational speed or acceleration of said wash-and-dewatering sink cyclically.

* * * * *